United States Patent [19]

Burkett

[11] 4,151,794

[45] May 1, 1979

[54] APPARATUS FOR TREATING ORGANIC MATERIALS

[76] Inventor: Albert L. Burkett, 1307 13th Ave., #712, Dodge City, Kans. 67801

[21] Appl. No.: 909,266

[22] Filed: May 24, 1978

[51] Int. Cl.[2] ..... B30B 15/30

[52] U.S. Cl. ..... 100/74; 100/95; 100/215; 100/264; 100/295; 241/154; 241/188 R; 241/275

[58] Field of Search ..... 100/94, 95, 39, 73, 100/74, 75, 215, 264, 244, 295; 241/154, 275, 186 R, 186.2, 188 R

[56] References Cited

U.S. PATENT DOCUMENTS

| | | | |
|---|---|---|---|
| 1,636,033 | 7/1927 | Agnew | 241/188 |
| 3,356,016 | 12/1967 | Eidal | 100/95 |
| 3,426,673 | 2/1969 | Miner | 100/39 X |
| 3,436,028 | 4/1969 | Koehnen | 241/186 R |
| 3,511,023 | 5/1970 | Schopp | 100/244 UX |
| 3,987,970 | 10/1976 | Burkett | 241/154 X |

*Primary Examiner*—Billy J. Wilhite
*Attorney, Agent, or Firm*—Herbert E. Haynes, Jr.

[57] ABSTRACT

Organic materials are fed tangentially into the head of a centrifugal mill by an adjustable rate feeding device. The materials, either in a dry state or in conjunction with a separately supplied liquid carrier, move downwardly through a compacter device which positively feeds the materials through a series of comminution devices which are arranged in an inverted conical housing and are of decreasingly smaller sizes, with the comminution means shredding the materials. The top of the mill is open to freely admit air which is admixed by the communition devices with the materials to satisfy the biochemical oxygen demand so that the output product of the mill is odor free and finely shredded.

13 Claims, 6 Drawing Figures

APPARATUS FOR TREATING ORGANIC MATERIALS

BACKGROUND OF THE INVENTION

1. Field of the Invention

This invention relates to the treatment of materials and more particularly to a centrifugal mill in combination with an adjustable rate feed device for treatment of organic materials.

2. Description of the Prior Art

The ever increasing waste disposal problems and interest in the recycling of various materials has in recent years spurred the design and development of many systems and devices for processing waste and other materials either for more efficient disposal or for recycling purposes. Many elaborate systems and devices have emerged such as the relatively small and simple magnetic separators, air classifiers and the like, all the way to the extremely large processing plants for specialized waste treatment purposes such as automobile crushing and material separating facilities.

In many installations, devices such as the above mentioned air classifiers, magnetic separators, large crushers, and the like are employed in an assembly line like fashion with each device designed to perform a particular function. This technique invariably results in very large and expensive facilities, with the end result being that many locations having relatively low volume and/or specialized needs cannot afford or otherwise justify such installations.

One such need is for an apparatus which processes low density frangible organic materials such as garbage, animal wastes, grass clippings, weeds, cotton stocks, corn stocks, grain, wastes from animal slaughter houses and the like.

Ideally, an apparatus for treatment of the above described organic materials should be relatively small, inexpensive, have a relatively low rate of energy consumption, and be otherwise suitable for installation on sites having special needs. To the best of my knowledge, no device has been devised or suggested for treating organic materials.

One such mechanism which comes close to filling such requirements is fully disclosed in U.S. Pat. No. 3,987,970 issued on Oct. 26, 1976 to the same inventor. That mechanism is a centrifugal mill which is designed for simultaneously treating solid refuse, such as the waste materials normally collected from domestic and commercial sources, and simultaneously treating such refuse with a liquid carrier medium such as sewage effluent to produce a pumpable slurry. The solid refuse and liquid carrier are fed into the head of the centrifugal mill and are directed to a pre-breaker means. The pre-breaker means is a centrally located rotating device which tears garbage containers apart such as the commonly used plastic bags, cardboard cartons, tin cans and the like, and throws those containers and the contents against the side walls of the mill. Gravity then causes these materials to flow downwardly through a series of comminution means which shreds the solid refuse, blends it with the liquid carrier and mixes air therewith to produce an odor free pumpable slurry. The slurry exits the mill through adjustable flow control means by which the through-put rate of the mill is controlled. This particular prior art centrifugal mill is ideal for its intended purpose, however, it lacks efficiency when organic materials are processed therethrough in that the pre-breaker means is not particularly effective in handling these relatively light weight frangible organic materials.

Therefore, a need exists for an apparatus for treating frangible organic materials.

SUMMARY OF THE INVENTION

In accordance with the present invention, a new and useful apparatus is disclosed for treatment of organic materials. The apparatus of the present invention includes the combination of an adjustable rate feeding device, such as an apron feeder, vibrating plate feeder and the like, for supplying organic materials to a centrifugal mill at a predetermined feed rate. The centrifugal mill is provided with a tangentially disposed input port which directs the incoming organic materials to a compacter means, such as a diametrically opposed pair of simultaneously and synchronously operated rams which crush the materials and positively feed them to the uppermost one of a serially disposed plurality of rotating comminution means. The upper end of the centrifugal mill is preferrably open to allow an unrestricted inflow of air, or alternately, air or oxygen can be injected under pressure into the mill. The comminution means which shreds the waste materials and mixes them with air to satisfy the biochemical oxygen demand of the materials are arranged within an inverted conically shaped housing and are disposed so as to be decreasingly sized. Such a downwardly converging arrangement of the housing and comminution means causes the descending materials to be confined within decreasingly smaller areas so as to increase the shredding and aerating forces applied by the comminution means. The lowermost one of the comminution means, in addition to operating as described above, also causes the shredded and aerated organic materials to be expelled from the mill through a tangentially disposed output port.

In addition to the unrestricted inflow of air into the top of the centrifugal mill, a liquid input port may also be provided so that the organic materials may, if desired, be treated in a liquid carrier medium in addition to the air. The liquid carrier may consist of water, sewage effluent, and the like, and may consist solely, or in part, of a chemical additive which would enhance the characteristics of the particular output product of the mill. For example, if the output product of the mill is to be an insulation material, a fireproofing chemical, insect retarding chemical, or otherwise, may be added to the materials and blended therewith during its passage through the mill. If the output product is to be a fertilizer or animal food, nutrient enriching additives can be simultaneously added through the liquid input port of the mill.

Accordingly, it is an object of the present invention to provide a new and useful apparatus for handling and treating organic materials.

Another object of the present invention is to provide a new and useful apparatus for handling and treating organic materials, with the apparatus including the combination of an adjustable rate feed device, and a centrifugal mill.

Another object of the present invention is to provide a new and useful apparatus of the above described character in which organic materials are fed at an adjustable rate by the feed mechanism into the upper portion of the centrifugal mill so as to come into contact with a compacter means which positively feeds the material downwardly through a serially disposed plurality of comminution means for shredding and aeration thereof.

Another object of the present invention is to provide a new and useful apparatus of the above described type in which the centrifugal mill is provided with air input means in the head thereof so that the organic materials being shredded by the centrifugal mill will be simultaneously aerated to satisfy the biochemical oxygen demand of the materials.

Another object of the present invention is to provide a new and useful apparatus of the above described character in which the centrifugal mill is provided with a liquid input port in the head thereof so that the organic material may be handled in a liquid carrier medium if desired.

Still another object of the present invention is to provide a new and useful apparatus of the above described type in which the centrifugal mill is provided with a liquid input port in the head thereof so that chemical additives may be added to the materials if desired.

Yet another object of the present invention is to provide a new and improved apparatus of the above described type in which the plurality of comminution means are disposed within a housing of inverted conical configuration and the comminution means are arranged and configured to be of downwardly decreasing size, to increase the shredding and aerating forces exerted on the organic materials by the comminution means as the materials pass downwardly therethrough.

The foregoing and other objects of the present invention, as well as the invention itself, may be more fully understood from the following description when read in conjunction with the accompanying drawings.

DESCRIPTION OF THE PREFERRED EMBODIMENT

Figure 1:
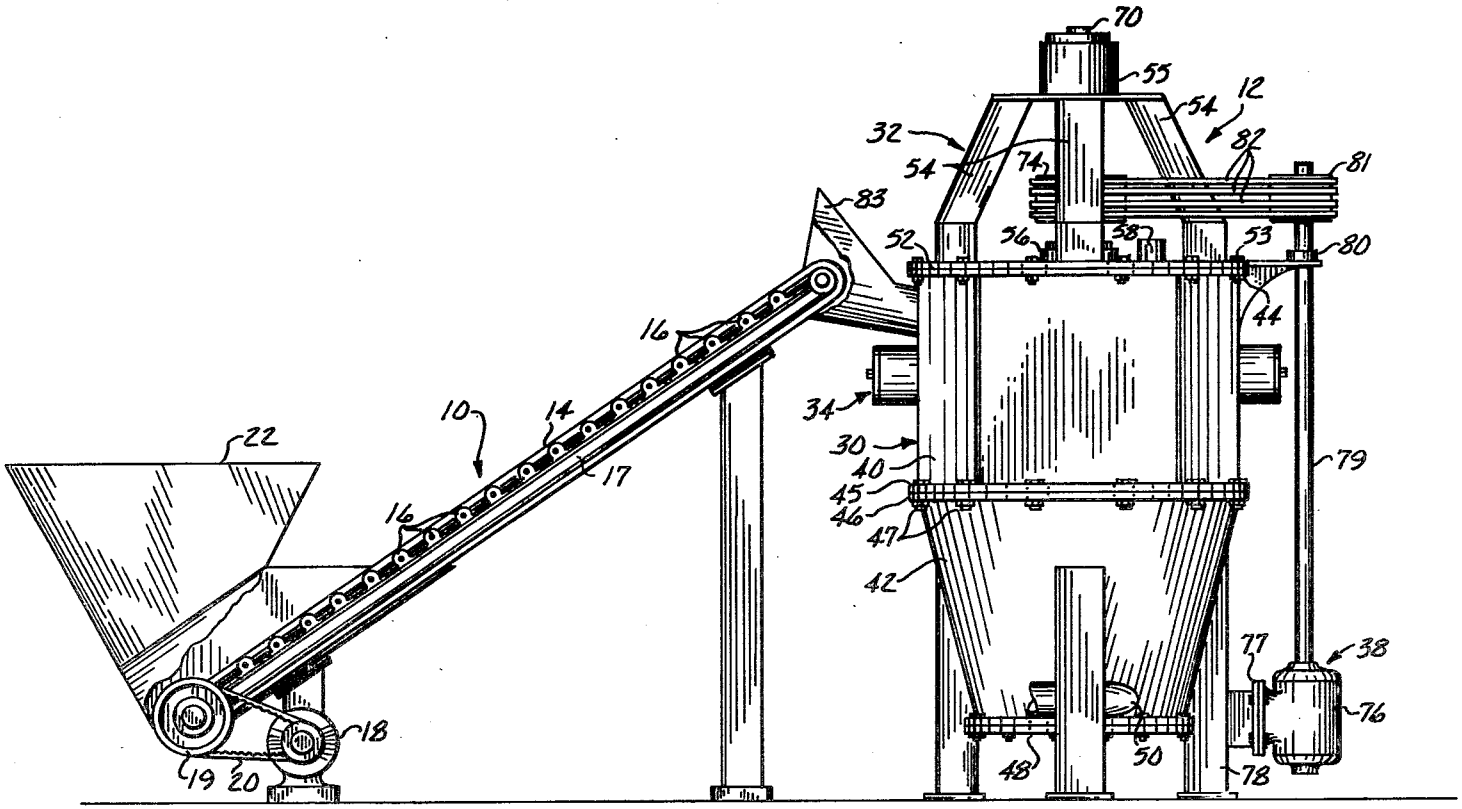
FIG. 1 is an elevational view of the apparatus of the present invention illustrating the various features thereof.

Referring more particularly to the drawings, FIG. 1 illustrates the apparatus of the present invention which is formed of a combination of an adjustable rate feeding means indicated in its entirety by the reference numeral 10 and a centrifugal mill which is indicated in its entirety by the reference numeral 12.

As will hereinafter be described in detail, proper and efficient operation of the apparatus of the present invention requires that the organic materials be evenly and smoothly fed to the centrifugal mill 12 at a controlled rate, and the adjustable rate feeding means 10 is designed to meet those requirements.

As seen in FIG. 1, the preferred adjustable rate feeding means 10 is in the form of an apron feeder, which as is well known in the art, are heavy duty conveyors that are especially designed to eliminate material slippage, surge loading, and the like to provide consistent even feeding of materials at various rates, and thus prevent choking of the equipment fed thereby.

Figure 3:
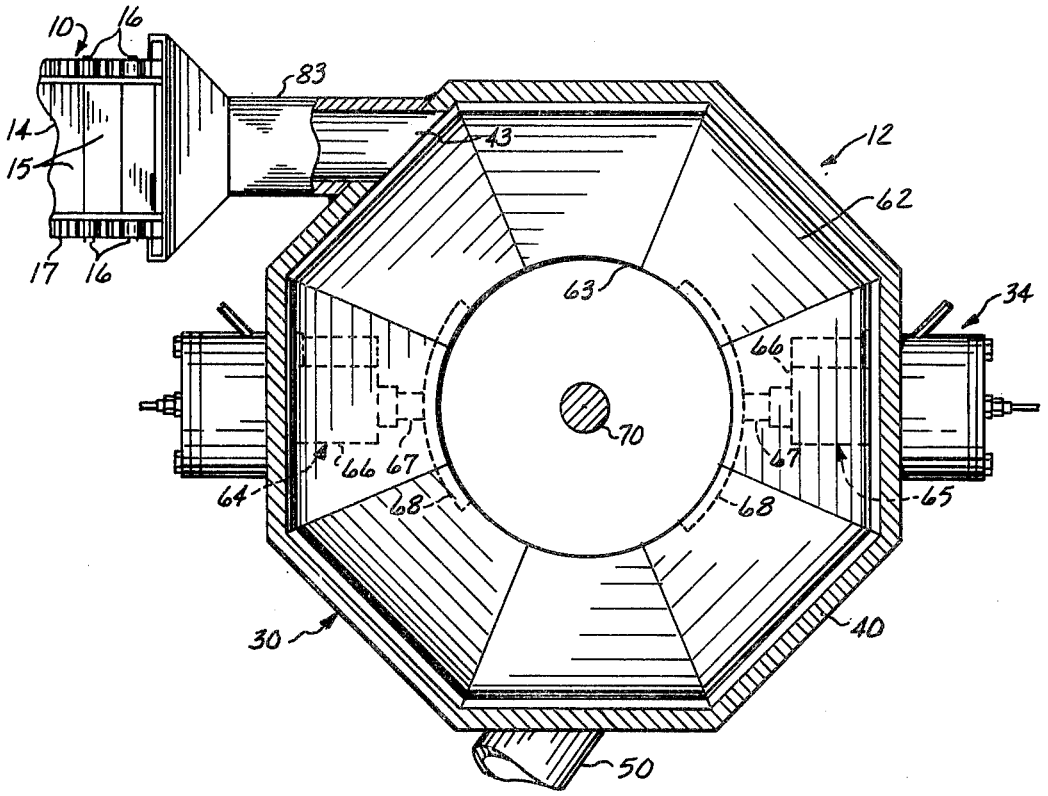
FIG. 3 is a sectional view taken along the line 3—3 of FIG. 2.

Briefly, the apron feeder 10 includes an endless apron 14 which comprises a plurality of hingedly interconnected steel flights 15 (FIG. 3), each of which has upstanding flanged side edges to prevent lateral material slippage. The apron 14 is supported on a plurality of rollers 16 transversely mounted in a frame 17. A suitable variable speed electric motor 18 is employed to drive the sprocket 19 of the apron feeder 10, such as with a belt 20. Organic materials are delivered by any suitable means (not shown), to an input hopper 22 which deposits those materials on the tail end of the apron feeder 10 which then carries those materials upwardly to the top or head of the feeder for delivery to the centrifugal mill 12, as will hereinafter be described.

Apron feeders of the above described type are well known, and one source for such mechanisms is the Smith Engineering Works, a Division of Barber-Greene, Milwaukee, Wisconsin, 53201, which markets such devices under the trade name "Telsmith".

It should be understood that although the apron feeder 10 is preferred, other types of mechanisms may be employed, such as a reciprocating plate feeder (not shown), vibrating feeders (not shown), and the like.

As will hereinafter be described in detail, the centrifugal mill 12 includes the following major components and subassemblies: a vertically disposed housing assembly 30, a head assembly 32 mounted atop the housing 30, a materials compacting means 34, and a materials shredding and aerating means 36 which are both mounted in the housing assembly 30 and a drive means 38 for operating the centrifugal mill 12.

Figure 2:
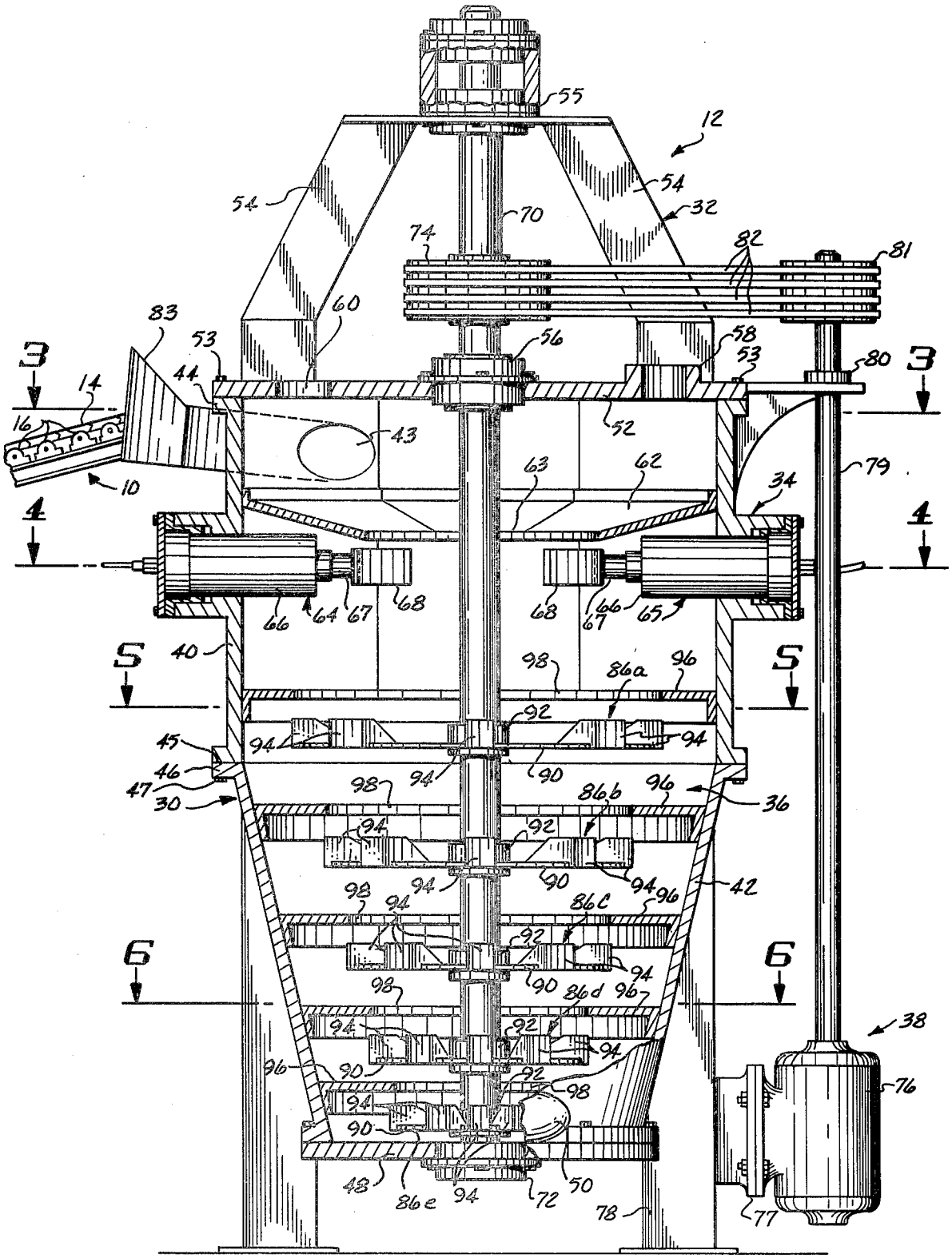
FIG. 2 is a longitudinal sectional view of the centrifugal mill which forms part of the apparatus of the present invention.

The housing assembly 30, as best seen in FIG. 2, includes an upper housing body 40 and a flower housing body 42. The upper body 40 has a materials input port 43 formed tangentially in the upper end thereof and is provided with an upper endless flange 44, and a lower endless flange 45 formed on opposite ends thereof. The upper housing body 40 may be of any suitable cross sectional configuration, but is preferrably fabricated of a plurality of flat plates suitably interconnected, such as by welding, to form a multi-sided endless side wall such as of octagonal configuration. The multi-sided configuration is preferred for ease of fabrication and to provide desirable turbulent internal air flow characteristics as will become apparent as this description progresses. The lower housing body 42 has an endless flange 46 formed on its upper end which is coupled, such as by bolts 47, to the lower flange 45 of the upper housing body 40. The lower housing body 42 is of inverted frustro-conical configuration as will hereinafter be described in detail, and has a bottom plate 48 suitably attached thereto and a tangentially disposed materials discharge port 50 formed in the conical side wall adjacent the bottom plate.

The head assembly 32 includes a flat head plate 52 which is affixed to the upper flange 44 of the upper housing body 40 such as with bolts 53. A plurality of struts 54, or beams, extend convergingly upwardly from the head plate 52 and support a first bearing means 55 at the apex thereof, so that the first bearing means is spaced above and coaxial with the longitudinal axis of the housing assembly 30. The flat head plate 52 has a second bearing means 56 mounted centrally therein so as to be coaxial with the first bearing means 55 and is therefore, coaxial with respect to the longitudinal axis of the housing assembly 30. As will hereinafter be described in detail, the flat head plate 52 of the head assembly 32 has a liquid injection port 58 and at least one air inlet port 60 formed therein so as to be in communication with the interior of the centrifugal mill 12.

Figure 4:
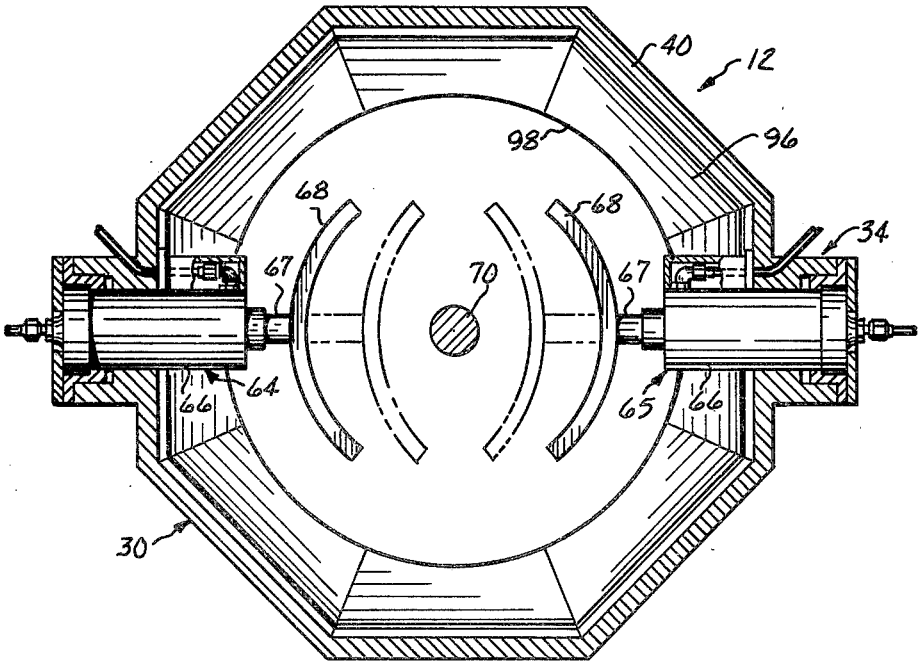
FIG. 4 is a sectional view taken along the line 4—4 of FIG. 2.

The materials compacting, or crushing means, 34 is mounted in the upper housing body 40 immediately below the tangentially disposed materials input port 43, and is seen to include a dish shaped shelf 62, which is affixed to the interior surfaces of the endless side wall of the upper housing body 40, and has a centrally located circular opening 63 formed therethrough. A pair of identical rams 64 and 65 are mounted in diametrically opposed portions of the endless side wall of the upper housing body 40 so as to be located immediately below the shelf 62. Since the rams 64 and 65 are identical, the following description of ram 64 will be understood to also apply to the ram 65. As shown, the ram 64 includes a suitable cylinder 66, which may be hydraulically, pneumatically, or otherwise operated, to reciprocally move a piston rod 67 which is provided with an arcuate striker plate 68 on the inwardly extending free end thereof. Although not shown, it will be understood that suitable switching devices, that are well known in the art, are coupled to the cylinder 66 to provide a rapid reciprocating movement of the piston rod 67 and thus the arcuate striker plate 68. Therefore, as best seen in FIGS. 2 and 4, the diametrically opposed striker plates 68 of the rams 64 and 65 are disposed immediately below the central opening 63 of the shelf 62 and are synchronously operated to exert compacting or crushing forces on the organic materials which fall through the opening 63.

It should be understood that the above described pair of rams 64 and 65 are merely exemplary as other types of mechanisms could be employed to exert the desired compacting or crushing forces. It will be obvious that more than two rams can be employed, or that the desired objectives could be accomplished with another type of structure such as a baler used to bale hay and the like.

A shaft 70 is rotatably mounted in the first and second bearing means 55 and 56 of the head assembly 32 so as to depend coaxially therefrom into the bore of the housing assembly 30. It should be noted that the shaft 70 may be dependingly suspended from the first and second bearing means 55 and 56, or as shown, may have its lowermost end rotatably journaled in a third bearing means 72 carried centrally in the bottom plate 48 of the lower housing body 42. In either case, that portion of the shaft 70 which extends between the first and second bearing means 55 and 56 has a driven pulley 74 affixed thereto, and the depending portion of the shaft has rotating portions of the materials shredding and aeration means 36 mounted thereon, as will hereinafter be described in detail.

The drive means 38 includes a variable speed electric motor 76 which is affixed to a suitable mounting plate 77 that is carried for example, on one of the legs 78 which support the centrifugal mill 12. The motor 76 has an elongated output shaft 79 which extends upwardly from the motor alongside the housing assembly 30 and is rotatably journaled in a suitable bearing 80 that is coupled to the side of the upper housing body 40. The uppermost end of the motor's output shaft 79 has a drive pulley 81 mounted thereon and a plurality of belts 82 are employed to couple rotary motion of the drive pulley 81 to the driven pulley 74.

Low density frangible organic materials such as garbage, animal wastes, grass clippings, cotton stalks, corn stalks, grains, wastes from animal slaughter houses and the like are supplied at a controlled rate to the input hopper 83 and will enter the mill 12 through the tangential input port 43. Upon entering the mill 12 the organic materials land on the dish shaped shelf 62 and will fall through the central opening 63 thereof into the impact area between the arcuate striker plates 68 of the compacter means 34. Depending upon the size and nature of the organic materials, the compacter means 34 will crush some materials such as corn stalks, animal bones, and the like, and will rupture and separate other materials such as baled hay, the rumen of slaughtered animals, and the like. The materials thus compacted will be substantially concentrated in this impact area and will fall into the materials shredding and aerating means 36 in what may be described as a positive feeding technique.

Figure 5:
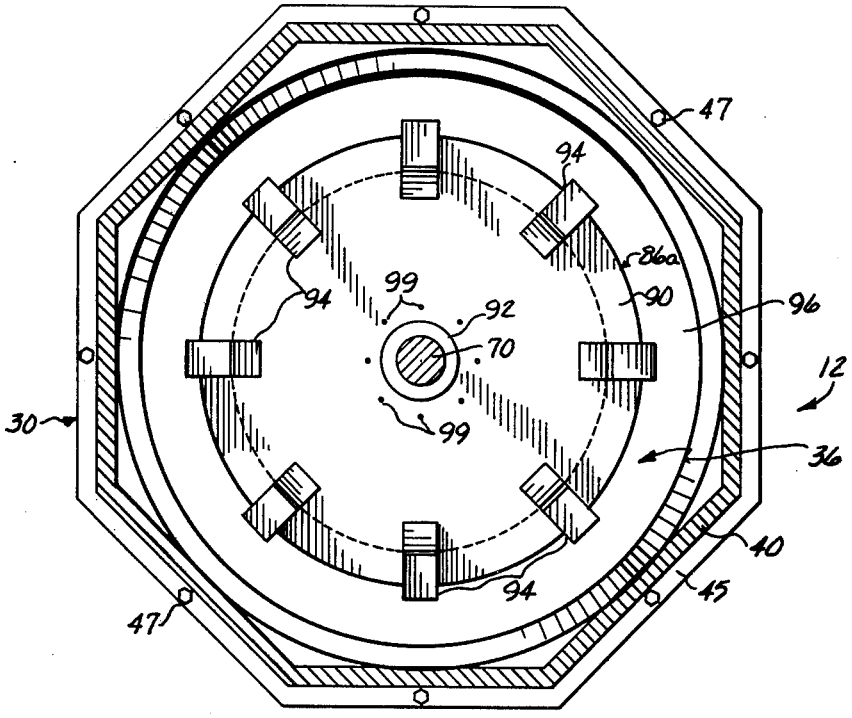
FIG. 5 is a sectional view taken along the line 5—5 of FIG. 2.
Figure 6:
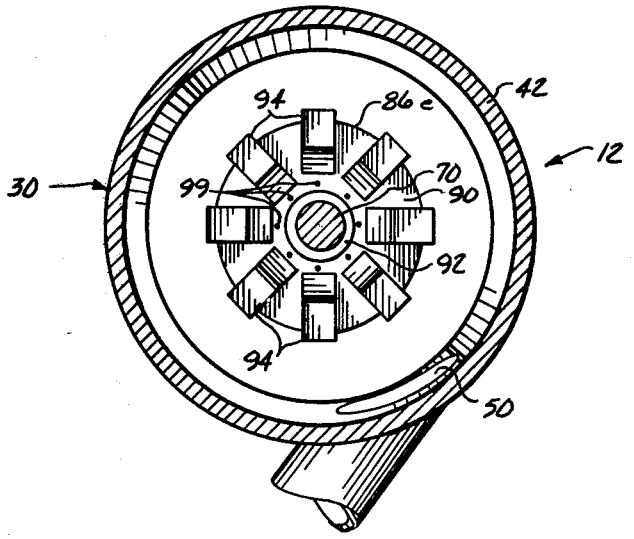
FIG. 6 is a sectional view taken along the line 6—6 of FIG. 2.

As seen best in FIGS. 2, 5 and 6, the materials shredding and aerating means 36 includes a spaced series of comminution means **86*a*, 86*b*, 86*c*, 86*d* and 86*e*, which are identically configured with the exception of the size as will hereinafter be described in detail. Since each of the comminution means 86*a*–86*e* are identically configured, it will be understood that the following description relating to the uppermost or first in the series of comminution means 86*a*** also relates to the other mechanisms.

The comminution means **86*a* comprises a circular disc or plate 90 having a central hub 92 which is suitably affixed to the shaft 70 so that the disc will rotate therewith. A plurality of striker members 94 are affixed to the plate 90 adjacent the peripheral edge thereof, with the striker members 94 arranged in equally spaced radial increments and disposed to extend upwardly from the upper surface of the plate and to extend somewhat beyond the peripheral edge thereof. Each of the striker members 94 are relatively large and heavy blocks of metal which contributes significantly to the flywheel effect of the comminution means, and will exert considerable shredding and impact forces on the organic materials passing through the centrifugal mill 12. An endless shelf structure 96 is fixed in the bore of the housing assembly 30 proximate each of the comminution means 86*a*–86*e*, and the shelves 96 are disposed immediately above the path of rotation of their respective ones of the comminution means. The shelves 96 are each formed with a centrally located circular opening 98 therethrough which is concentric with the shaft 70 and the plates 90. The circular openings 98 formed in the shelves 96 are preferrably somewhat smaller in diameter than the circular path which the extending ends of the striker members 94 follow when the comminution means 86*a*–86*e* are being rotatably driven and this relationship assures that all of the organic materials emerging from the compacter means 34 will move serially into engagement with the comminution means 86*a*–86*e***.

The plate members 90 of the comminution means **86*a*–86*e* are each provided with a plurality of apertures 99 formed proximate the hubs 92** thereof to relieve the negative static pressure which would otherwise occur in those areas due to the rotation of the comminution means.

It may now be seen that the movement of the organic materials downwardly through the centrifugal mill 12 will first subject those materials to the compressing and crushing forces exerted by the compacter means 34 and will subsequently subject the materials to the action of the series of comminution means 86a–86e. When the organic materials move into the vicinity of the lowermost one of the comminution means 86e, the materials will be in a finely shredded state, the size of the materials being determined by the number of comminution means, and the character of the materials being processed, and that shredded material will be impacted by the lowermost comminution means 86e and will exit the mill 12 through the tangentially disposed discharge port 50, due to the pushing or sweeping action of the lowermost comminution means.

As hereinbefore mentioned, the flat head plate 52 of the head assembly 32 is provided with at least one air inlet port 60 through which air is supplied to the interior of the centrifugal mill. It will be seen that the natural action of the centrifugal mill 12, i.e., the rotary motion of the material shredding and aerating means 36, and the natural flow of materials through the mill, will cause a flow of relatively large volumes of air therethrough, and for reasons which will become apparent as this description progresses, that natural flow of air may be augmented, or entirely replaced by suitable mechanisms (not shown) which inject air and/or oxygen under pressure into the centrifugal mill 12.

It has been theorized that the violent shredding action taking place in the centrifugal mill 12, which in conjunction with a plentiful supply of air and/or oxygen, causes a speedup in the aerobic bacteria growth in purticidable materials so that the materials emerging from the mill 12 will be odor free due to the biochemical oxygen demand having been satisfied.

In some instances, it may be desirable to add a liquid carrier medium to the organic materials for simultaneous processing thereof in the centrifugal mill 12. In addition to the desirability, in some instances, of producing a wet product or a product in a pumpable slurry, in other instances it may be advantageous to mix nutrients or other additives to the product. By way of example, if the product of the centrifugal mill 12 is to be used as an insulation, boric acid or other suitable chemicals may be supplied to the centrifugal mill so that the resulting product will be fire resistant. Further, if the product of the mill is an animal feed or fertilizer, suitable nutrients may be added. Therefore, the head plate 52 of the head assembly 32 is provided with the previously mentioned liquid injection port 58.

As hereinbefore described, the lower housing body 40 is of inverted frustro-conical configuration, and the comminution means 86a–86e, as seen in FIG. 2, are decreasingly sized, i.e., the plate 90 of the uppermost comminution means 86a is larger in diameter than the plate 90 of the next progressively lower comminution means 86b, etc., with the lowermost comminution means 86e having its plate 90 formed with the smallest diameter. With the above described configurations of the lower housing body 42 and the comminution means 86a–86e, it will be seen that the downwardly moving organic materials and air (and liquids if added) will be progressively confined in increasingly smaller areas, and as a result will increase in velocity in accordance with Bernoulli's principle. This increase in velocity in conjunction with the rotation of the comminution means 86a–86e produces an increasingly violent turbulence which enhances the shredding of the waste materials and the mixing of the air (and liquid) therewith.

It will now be seen that in order for the centrifugal mill to operate at peak efficiency, a substantially even flow of organic materials therethrough is necessary. Thus, to prevent organic materials from piling up, clogging or otherwise restricting the materials flow and decreasing the mill's efficiency, or in the event that the liquid carrier medium is added to prevent a liquid buildup therein, the previously described adjustable flow rate feeding means 10 is set so that the organic materials cannot be fed to the mill at a rate above that which the mill can efficiently process. That flow rate is, of course, determined by such factors as the character of the organic materials being processed, size of the discharge port 50, and the like.

It will now be appreciated, and as hereinbefore mentioned, the output product of the apparatus of the present invention is finely shredded and odor free, and is therefore in ideal condition for further handling such as transport, storage, disposal and the like, as determined by its intended usage and the requirements of particular installations.

Many materials which heretofore were treated as waste or garbage, can be processed by the apparatus of the present invention into useful products. This is advantageous from economic and environmental standpoints, with the economic advantages being obvious and the environmental advantages being derived from the fact that less materials will be deposited in land fill sites, and the materials deposited therein will be much more compressible and will be much more sanitary due to the biochemical oxygen demand having been satisfied.

With regard to the transporting, storage and the like of the product, the finely shredded and odor free state thereof results in a considerable volume reduction and substantial improvement in compressibility. In such a state, the product is ideally suited for a bagging operation, in that the product can be directed into a mechanism such as that known as an Eberhardt Silopress (not shown). That particular mechanism, which is fully disclosed in U.S. Pat. No. 3,687,061, will bag the product of the apparatus of the present invention in sealed containers which are well suited for transporting, storage and the like.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An apparatus for shredding and aerating organic materials comprising:

(a) a centrifugal mill having a vertical bore with the lower end of said mill being of inverted frustro-conical configuration, said mill having a head section at the upper end and a discharge port at the lower end;

(b) an input port formed in the upper end of said mill for receiving the organic materials;

(c) means in the head section of said mill for admitting air to the bore of said mill;

(d) compacting means in said mill immediately below said input port and operable to apply compacting and crushing forces on the materials receivable through said input port;

(e) shredding and aerating means in said mill below said compacting means and comprising, I. a shaft coaxially disposed and rotatably journaled in said mill, and II. at least a pair of comminution means affixed to said shaft for rotation therewith, said comminution means axially spaced on said shaft below said compacting means and axially spaced with respect to each other for serially impacting and aerating the materials which emerge from said compacting means, said comminution means downwardly decreasing in size and located substantially within the inverted frustro-conical end of said mill;

(f) means coupled to said shaft for rotatable driving thereof; and (g) feed means for receiving and evenly delivering the organic materials to said input port, said feed means being adjustable to set the maximum delivery rate of the materials equal to the maximum discharge capacity of the discharge port of said mill.

2. An apparatus as claimed in claim 1 wherein said compacting means comprises:

(a) a dish shaped shelf mounted in the bore of said mill and having a central opening formed therethrough; and (b) at least a pair of rams mounted in diametrically opposed relationship in said mill immediately below said shelf, said pair of rams synchronously reciprocally operable toward and away from each other.

3. An apparatus as claimed in claim 2 wherein each of said rams comprises:

(a) a cylinder extending radially into the bore of said mill;

(b) a piston rod reciprocally extensible from said cylinder; and (c) a striker plate on the extending end of said piston rod.

4. An apparatus as claimed in claim 1 wherein each of said comminution means comprises:

(a) a circular plate affixed centrally thereof to said shaft for rotation in a plane transverse to the longitudinal axis of said shaft; and (b) a plurality of striker members disposed adjacent the periphery of said plate in evenly spaced radial increments, said striker members extending upwardly from the upper surface of said plate and beyond the periphery thereof, each of said striker members being a metallic block.

5. An apparatus as claimed in claim 1 wherein each of said comminution means includes a circular plate, each subsequently lower one of said comminution means having its plate of smaller diameter than the plate of the one of said comminution means that is spaced thereabove.

6. An apparatus as claimed in claim 1 wherein said shredding and aerating means further comprises:

an endless shelf fixed in the bore of said centrifugal mill above each of said comminution means, each of said shelves circumscribing a central opening which is coaxial with said shaft.

7. An apparatus as claimed in claim 1 wherein said means in the head section of said centrifugal mill for admitting air comprises at least one port communicating with the bore of said mill.

8. An apparatus as claimed in claim 1 and further comprising port means formed in the head section of said centrifugal mill and communicating with the bore thereof, said port means for admitting a liquid to the bore of said centrifugal mill.

9. An apparatus as claimed in claim 1 wherein said input port is tangential with respect to the bore of said centrifugal mill.

10. An apparatus as claimed in claim 1 wherein the discharge port formed in the lower end of said centrifugal mill is tangential with respect thereto.

11. An apparatus as claimed in claim 1 wherein the head section of said centrifugal mill comprises:

(a) a head plate on the upper end of said mill for closing the bore thereof;

(b) a plurality of struts extending upwardly and convergingly from said head plate;

(c) a first bearing means supported by said struts at the apex thereof, said first bearing means having said shaft rotatably journaled therein; and (d) a second bearing means mounted centrally in said head plate and having said shaft rotatably journaled therein.

12. An apparatus as claimed in claim 11 and further comprising a third bearing means mounted in the bottom of said centrifugal mill and having the lower end of said shaft rotatably journaled therein.

13. An apparatus as claimed in claim 1 wherein said feed means comprises an apron feeder.

* * * * *